United States Patent [19]

Besaw

[11] Patent Number: 4,724,821

[45] Date of Patent: Feb. 16, 1988

[54] BOW STRING RELEASE DEVICE

[76] Inventor: Jean B. Besaw, Rte. 4, Box 251, New London, Wis. 54961

[21] Appl. No.: 817,264

[22] Filed: Jan. 9, 1986

[51] Int. Cl.[4] ..... F41C 19/00

[52] U.S. Cl. ..... 124/35 A

[58] Field of Search ..... 124/35 A; 24/135 N, 24/115 A

[56] References Cited

U.S. PATENT DOCUMENTS

| | | | |
|---|---|---|---|
| 358,069 | 2/1887 | Pratt | 24/135 N |
| 3,937,206 | 2/1976 | Wilson | 124/35 A |
| 4,022,181 | 5/1977 | Fletcher | 124/35 A |
| 4,309,975 | 1/1982 | Altier | 124/35 A |
| 4,426,989 | 1/1984 | Sutton | 124/35 A |
| 4,489,705 | 12/1984 | Larson | 124/35 A |

*Primary Examiner*—William H. Grieb
*Assistant Examiner*—Benjamin H. Layno
*Attorney, Agent, or Firm*—Nicholas A. Kees; James E. Nilles

[57] ABSTRACT

An improved bow string release device which permits the archer to fire the arrow by merely slightly relaxing a portion of his hand which holds the device. It includes an elongated body having a loop and a pivotable release lever attached to one end, and a rope-type handle attached to the opposite end and adjusted to be held by the last two fingers of the archer's hand. The loop is doubled over the bow string and hooked behind the release lever. The archer then holds the release lever against the body, with just his thumb and index finger. The bow string is released, and thus the arrow fired, by merely relaxing the thumb.

7 Claims, 4 Drawing Figures

BOW STRING RELEASE DEVICE

BACKGROUND OF THE INVENTION

This invention relates to devices for facilitating the smooth and even release of a bow string in archery, and in particular to such devices which do not require direct metal to bow string contact but which still produce a consistently reliable and reproducible arrow release, shot after shot, and are simple and inexpensive.

Various types of mechanical archery bow string release devices have been developed to improve shooting accuracy. The hook or ledge type is very popular. It usually involves a simple metallic or plastic hand-held ring or the like with a hooked projection adapted to engage the bow string at a single location. When the bow string is fully drawn and the bow has been fully aimed, the archer turns the ring or allows it to rotate so that the bow string suddenly slips off the projection and is released. Similar devices are shown in the U.S. Pat. No. 4,316,443, issued to Giacomo, and in the U.S. Pat. No. 4,424,791, issued to Muehleisen. With such devices it may be difficult to reproduce closely the angle and movements relating to the release from one shot to the next. There is also the danger that an archer could inadvertently allow the device to slip, prematurely firing the arrow.

A certain release sometimes termed a rope release may be more desirable as to this latter problem since it usually includes a rope retainer which is more resistant to slippage of the bow string. In addition, the string or rope which wraps around the bow string to draw it, dampens undesirable bow string vibrations which could otherwise cause inaccurate and non-reproducible release of the bow string. Examples of this type of device are shown in the U.S. Pat. No. 3,800,774, issued to Troncoso, and in the U.S. Pat. No. 3,853,111, issued to Stanislawski et al. In order to release the bow string from these releases, however, it is necessary for the archer to move his hand in a way which may be difficult to reproduce from one shot to the next.

Another type of release, commonly called the trigger release, reduces the hand movements required to release the bow string and makes the release action more reproducible. Examples of this type of release are shown in the U.S. Pat. No. 4,004,564 to Castonguay, and in the U.S. Pat. No. 4,083,348, to Fletcher. As can be seen, though, the devices shown in these patents may be quite complicated and expensive, reducing their effectiveness and reliability to the average archer. Moreover, certain of the parts are subject to substantial wear in use, due to the forces exerted on the trigger elements.

This invention relates to improvements over the devices described above and to solutions to the problems raised thereby.

SUMMARY OF THE INVENTION

The invention is a rope-type release having a single loop at one end of an elongated body. After wrapping around the bow string, the end of the loop is held by a lever in turn held by the archer. A sling-type rope handle is provided, adjustably attached to the opposite end of the body. To use the device the archer holds the body by the handle with his ring finger and little finger. His thumb and index finger hold the lever against the body. Simple relaxation of the archer's hand is then sufficient to release the arrow.

It is an object of the invention, then, to combine the advantages of a trigger-type release with those of a rope-type release, with none of the disadvantages of either.

A more specific object of this invention is to provide a bow string release wherein the pressure of the bow string is held by one part of the archer's hand while the release lever is held by another part, so that relaxation of the second part is sufficient to release the arrow, and so that the archer may more closely concentrate on releasing the lever the exact same way each time.

Other objects and advantages of the invention will become apparent hereinafter.

DESCRIPTION OF THE PREFERRED EMBODIMENTS

Figure 1:
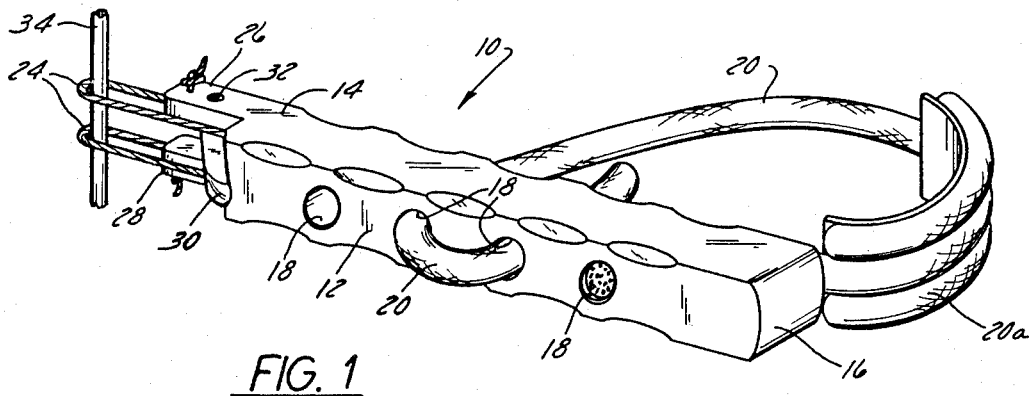
FIG. 1 is an isometric view of one embodiment of the invention.
Figure 2:
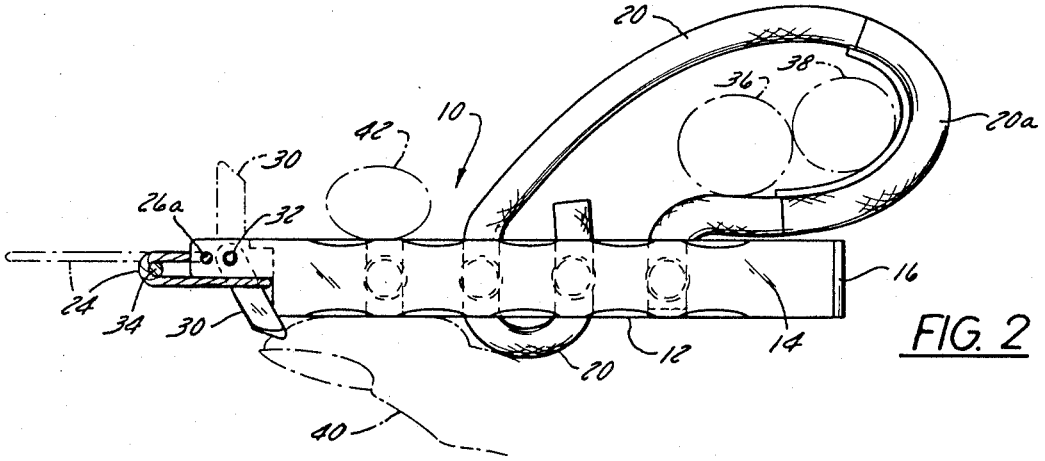
FIG. 2 is a top view of the embodiment shown in FIG. 1.
Figure 3:
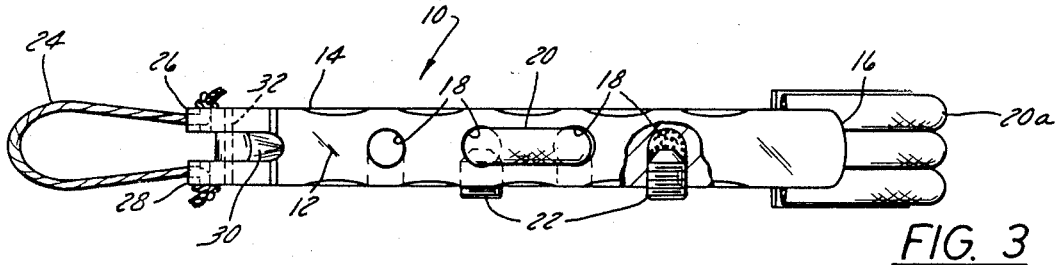
FIG. 3 is a side view of the embodiment shown in FIG. 1, partially in section.

Referring now to FIGS. 1–3, a novel bow string release device is shown generally at 10. The device 10 includes a generally elongated body 12 having two ends, a loop end 14 and a handle end 16. The body 12 has a plurality of parallel horizontal holes 18 formed transversely therethrough. A rope-type handle 20 has two ends, each of which is threaded through one of the holes 18 and secured therein by any suitable means, such as set screws 22 (FIG. 3) threaded into body 12 aligned with but perpendicular to holes 18. A widened portion **20*a* of handle 20 may be provided near the end of handle 20 nearest the handle end 16 of body 12**, to improve the comfort of the archer when drawing the bow or holding it in drawn position for long periods.

Figure 4:
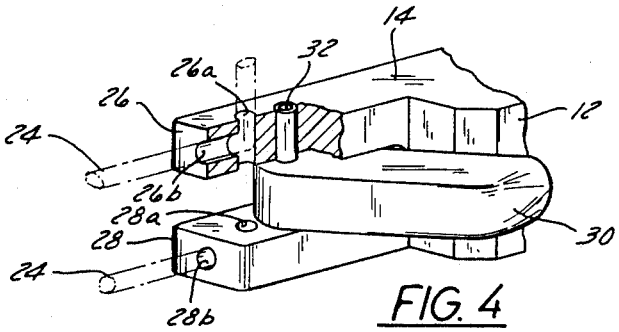
FIG. 4 is an enlarged fragmentary isometric view of the loop end of the body, partially in section to show the loop path in the body and the pin on which the release lever pivots.

A loop 24 of rope preferably finer than that of handle 20 is removably attached to the loop end 14 of body 12 by any suitable means. Preferably the attachment allows for easy replacement of loop 24 since this loop is the only part of the device 10 subject to any noticeable wear in use. As shown best in FIGS. 3 and 4, preferably loop end 14 of body 12 terminates in two spaced apart prongs 26 and 28 projecting longitudinally off the end of the body 12. As shown particularly in FIG. 4, holes **26*a* and 28*a* are formed transversely in the respective prongs, and may be aligned with each other. Holes 26*b* and 28*b* are formed longitudinally in the ends of the respective prongs, and only deep enough to intersect with the respective transverse holes 26*a* and 28*a*. Each end of loop 24 is then inserted in one of the end holes 26*b* and 28*b*, and exits toward the outside of body 12 via transverse holes 26*a* and 28*a*. A simple knot may then be tied in each end of loop 24 to retain it to loop end 14 of body 12. As referred to above, this attachment allows for easy replacement of the loop 24 if necessary. An additional advantage is that, with each end of loop 24 being inserted directly into the end of prongs 26 and 28, the side pressure and twisting evident in the bow string after release will be reduced. A release lever 30 is pivotably connected to the loop end 14 of body 12, preferably between the prongs 26 and 28 by any suitable means such as a roll pin 32 (FIG. 4**).

To use the release 10, the archer first inserts his fingers, preferably his ring finger 36 and little finger 38, into handle 20. He then doubles loop 24 over the bow string 34, as shown in FIGS. 1 and 2. The end of loop 24 is slipped over the release lever 30, and the lever is pivoted down against the body 12, preferably held there by the thumb 40 with the index finger 42 on the opposite side of body 12 for stabilization. The archer then pulls back on widened portion 20*a* of handle 20 while continuing to hold lever 30 against body 12 with his thumb 40 and index finger 42. The size of handle 20 can easily be adjusted by use of set screws 22 described above so that the archer's fingers may be properly placed on the release. Hence the tension applied to the bow string is counteracted with most of the archer's arm and hand and anchored with his ring and little fingers. His thumb and index finger may then be directed solely so as to reproducibly release the bow string and arrow by simply relaxing the thumb 40 carefully and under control until the release lever 30 slips from beneath the thumb. The release lever 30 then pivots about roll pin 32 due to the tension of the bow string, allowing loop 24 to unhook therefrom, releasing the bow string. The device then assumes the position shown in FIG. 2 in phantom. Accordingly, the archer is provided with a release device which can consistently yield highly reproducible releases with no noticeable wear on the bow string and without undesirable twisting and side pressure on the bow string.

While the apparatus hereinbefore described is effectively adapted to fulfill the aforesaid objects, it is to be understood that the invention is not intended to be limited to the particular preferred embodiments of bow string release herein set forth. Rather, the invention is to be taken as including various reasonable equivalents without departing from the scope of the appended claims.

I claim:

1. An improved bow string release device, comprising:

an elongated body having a handle end and a loop end, said loop end terminating in a pair of spaced apart prongs projecting longitudinally off the end of said body;

a handle attached to said body;

a loop having two ends, each one of said two ends of said loop being connected to said loop end of said body; and a rigid, one-piece release lever pivotably connected to said loop end of said body, and freely and nonlockably pivotable between either of two positions, a released position and a held position, such that said loop is doubled over a bow string and hooked under said release lever as said release lever is moved from said released position to said held position, and said release lever is maintained in said held position only by pressure continuously applied to the lever by the archer, and allowed to move to the released position only upon release of said pressure by the archer.

2. A device as recited in claim 1 wherein each one of said two ends of said loop is connected to a separate one of said prongs, and wherein said release lever is pivotably connected between said prongs.

3. A device as recited in claim 2 wherein each of said prongs has a transverse hole formed completely therethrough and a longitudinal hole formed in the end face thereof and only so deep as to intersect with said transverse hole, and wherein said loop is replaceably attached to said prongs by inserting each end of said loop into said longitudinal hole of each respective prong and out through said transverse hole of each respective prong, and tying a knot in the end of the loop.

4. A device as recited in claim 1 wherein said handle is a rope-type handle having two handle ends, each of said ends being adjustably fastened to said body.

5. A device as recited in claim 4 wherein said handle further comprises a widened portion between said handle ends for improving the comfort of the archer.

6. A device as recited in claim 4 wherein each of said handle ends is adjustably fastened to said body by inserting said handle ends into transverse holes formed in said body and fastening with threaded fasteners perpendicular to said holes.

7. A method of drawing a bow string and releasing an arrow therefrom by use of a bow string release device, said device including:

an elongated body having a handle end and a loop end, said loop end terminating in a pair of spaced apart prongs projecting longitudinally off the end of the body;

a rope-type handle having two handle ends, each of said handle ends being adjustably fastened to said body;

a loop having two ends, each one of said two loop ends being connected to a separate one of said prongs; and a release lever pivotably connected between said prongs, such that said loop can be doubled over a bow string and hooked under said release lever, the archer can apply tension to the bow string by pulling on the handle, and the archer can release the bow string by releasing said release lever;

said method comprising the steps of:

inserting the archer's ring finger and little finger through said handle;

doubling said loop over said bow string;

hooking said loop under said release lever;

holding said release lever against said body by use of the thumb and index finger;

pulling on said handle to apply tension to the bow string; and releasing said arrow by relaxing the thumb until said release lever slips away from it, allowing said release lever to pivot and unhook said loop, releasing the tension on the bow string.

* * * * *